US008720169B2

(12) United States Patent
Ehrmann et al.

(10) Patent No.: US 8,720,169 B2
(45) Date of Patent: May 13, 2014

(54) PACKAGING MACHINE COMPRISING A PLURALITY OF WORK STATIONS

(75) Inventors: Elmar Ehrmann, Bad Groenenbach (DE); Klaus Weiss, Bad Groenenbach (DE); Andreas Streitenberger, Altusried (DE)

(73) Assignee: Multivac Sepp Haggenmueller GmbH & Co. KG, Wolfertschwenden (DE)

( * ) Notice: Subject to any disclaimer, the term of this patent is extended or adjusted under 35 U.S.C. 154(b) by 105 days.

(21) Appl. No.: 13/193,923

(22) Filed: Jul. 29, 2011

(65) Prior Publication Data

US 2012/0023865 A1 Feb. 2, 2012

(30) Foreign Application Priority Data

Jul. 29, 2010 (EP) ..... 10007915

(51) Int. Cl.
*B65B 47/00* (2006.01)

(52) U.S. Cl.
USPC ..... 53/559; 53/329.2; 53/329.3; 100/207

(58) Field of Classification Search
USPC ..... 53/559, 329.2, 329.3; 100/193, 207, 100/208
See application file for complete search history.

(56) References Cited

U.S. PATENT DOCUMENTS

| | | | | |
|---|---|---|---|---|
| 3,269,236 | A | 8/1966 | Johnson et al. | |
| 3,948,115 | A | 4/1976 | Seragnoli | |
| 4,233,801 | A * | 11/1980 | Watt | 53/453 |
| 4,730,761 | A * | 3/1988 | Spano | 225/2 |
| 5,848,514 | A * | 12/1998 | Edwards et al. | 53/53 |
| 6,000,327 | A * | 12/1999 | Moriyasu et al. | 100/207 |
| 6,050,124 | A * | 4/2000 | Shiroza | 72/405.16 |
| 6,453,718 | B1 * | 9/2002 | Schmeink et al. | 72/405.1 |
| 6,941,729 | B2 * | 9/2005 | Dal Pozzo | 53/453 |
| 8,186,134 | B2 | 5/2012 | Shackelford et al. | |
| 2002/0157355 | A1 * | 10/2002 | Tampieri | 53/453 |
| 2004/0244339 | A1 * | 12/2004 | Dal Pozzo | 53/453 |
| 2010/0107572 | A1 * | 5/2010 | Slomp et al. | 53/559 |

FOREIGN PATENT DOCUMENTS

| | | | |
|---|---|---|---|
| CN | 2695356 | Y | 4/2005 |
| CN | 101307820 | A | 11/2008 |
| EP | 0 515 661 | B1 | 3/1994 |
| GB | 706844 | A | 4/1954 |

OTHER PUBLICATIONS

German Search Report Dated Mar. 1, 2011, Applicant Multivac Sepp Haggenmueller GmbH & Co KG, Application No. 10007915-1-2308, 5 Pages.

* cited by examiner

*Primary Examiner* — Thanh Truong
*Assistant Examiner* — Eyamindae Jallow
(74) *Attorney, Agent, or Firm* — Husch Blackwell LLP

(57) ABSTRACT

The disclosure relates to a packaging machine comprising a plurality of work stations which are operable in synchronism with one another and which define a production direction, each of said work stations including at least one movable tool member. The packaging machine is provided with a rotationally driven shaft arranged in the production direction of said packaging machine, and the shaft and each of the movable tool members of various work stations have provided between them at least one transfer mechanism for converting the movement of the shaft into the movement of the respective tool member.

8 Claims, 4 Drawing Sheets

PACKAGING MACHINE COMPRISING A PLURALITY OF WORK STATIONS

CROSS-REFERENCE TO RELATED APPLICATIONS

This application claims foreign priority benefits under 35 U.S.C. §119(a)-(d) to European patent application number EP 10007915.1, filed Jul. 29, 2010 which is incorporated by reference in its entirety.

TECHNICAL FIELD

This disclosure relates to a packaging machine comprising a plurality of work stations which are operable in synchronism with one another and which define a production direction of the packaging machine, said work stations being arranged in succession e.g. in said production direction, with each work station including at least one movable tool member.

BACKGROUND

The packaging machine may be a deep-drawing packaging machine. In such packaging machines the packaging material passes through a plurality of work stations in succession so as to subject the packaging material and/or the products to be packed to various working steps in temporal succession. In so doing, for example, packaging troughs are deep-drawn in the moving material at a forming station. Alternatively, prefabricated trays are removed from a destacker. The deep-drawn packaging troughs (or, alternatively, the pre-fabricated trays) are then filled with a product, the packages are evacuated and/or flushed with gas, they are sealed with a top foil or closed by means of a slip lid, and, if necessary, the packages are also separated from one another, checked and/or sorted out. These working steps take place in work stations which normally each include at least one movable tool member. The movable tool members of the individual work stations have to be synchronized with one another when the packaging machine is operated in an intermittent mode as well as in a continuous mode so as to guarantee a smooth operation of the packaging machine.

EP 0 515 661 B1 discloses a packaging machine of the type in question in the form of a deep-drawing machine. This machine is provided with a forming station for forming packaging troughs in a bottom foil as well as with a filling station and a sealing station. For each of the work stations a mechanism is provided for converting the rotation of an electric motor into a lifting movement of a tool member of the respective work station, such as, for example, the forming tool of the forming station, or the chamber part of the sealing station. In order to cause both sides of the respective tool to move upwards or downwards parallel to one another, a belt couples the movement of a plurality of shafts which extend transversely to the production direction of the packaging machine and the rotary movement of which is converted into a lifting movement of the respective tool member. This conventional packaging machine is, however, disadvantageous insofar as respective separate drives must be used for the different work stations. In particular, it is difficult to synchronize the movements of the tools of the different work stations with one another.

SUMMARY

The system of the present disclosure provides an improved packaging machine with a simpler, more compact design. This is achieved by a packaging machine having one or more the features described below.

The packaging machine of the present disclosure is provided with a rotationally driven shaft arranged in the production direction of said packaging machine. The shaft and each of the movable tool members of various work stations have provided between them at least one transfer mechanism for converting the rotational movement of the shaft into the movement required to operate the respective tool member. Since this shaft drives the tool members of a plurality of work stations, the movements of these tool members are automatically synchronized with one another through the movement of the shaft. This synchronization is effected mechanically and is therefore independent of potential errors of an electronic synchronization. The shaft arranged in the production direction of the packaging machine only requires comparatively little installation space so that the packaging machine can have a very compact structural design.

According to one embodiment, the transfer mechanism comprises an arrangement of toggle levers and/or a cam mechanism for converting the movement of the shaft into the movement of the respective tool member. In this way, the transfer mechanism is rendered robust and independent of high wear components, such as a belt. In addition, the comparatively high forces required for lifting the tool members can be transferred effectively by an arrangement of toggle levers or a cam mechanism.

When the transfer mechanism is provided with a cam mechanism, the latter preferably includes a wear-reducing element so as to reduce the wear-dependent load on the transfer mechanism and thus on the shaft. The wear-reducing element may, for example, consist of one or a plurality of wheels rolling along a cam profile. It is also contemplated to provide, as a wear-reducing element, the surface of a component of the cam mechanism with a material having a lower coefficient of friction and/or to execute a suitable surface treatment so as to reduce the friction on this surface.

The shaft may be driven in a continuous 360° rotation. This would have the advantage that a transmission between the shaft and the shaft driving unit, e.g. an electric motor or in particular a servomotor, could have a comparatively simple structural design. However, where alternating tool-member lifting movements are desired to be caused by the shaft, it may be more advantageous when the shaft is driven alternately in different directions of rotation.

Work stations of the packaging machine whose tool members are driven by means of the shaft so as to execute a lifting movement may e.g. be a forming station, a sealing station and/or a separating or cutting station. The packaging machine may also comprise a plurality of work stations of one of the above-mentioned types.

According to one variant of the packaging machine according to the present disclosure, at least two work stations of the packaging machine are arranged on different vertical levels. This would have the advantage that the work stations can be arranged more closely to one another in the horizontal direction, so that the structural design of the packaging machine can be rendered even more compact. In particular, it would be possible that two work stations are even arranged one above the other and/or that a packaging material is deflected by 180° between two work stations so as to be transferred from a first conveying plane to a second conveying plane.

It should be noted that relative positional or orientative terms such as "vertical", "horizontal", "upper", "lower", "forward", and "backward", are used herein to describe locations and direction based upon an assumption that the machine is installed for operation where the longitudinal axis of the packaging machine and the drive shaft extend in a horizontal direction, and the packaging material moves "forward" in the production direction of the machine. Thus, it will be understood that, regardless of the orientation of the machine, "horizontal" will always be understood to be substantially parallel to the longitudinal axis of the longitudinal axis of the machine, as well as to the longitudinal axis of the drive shaft, and forward will always refer to movement in the production direction, regardless of the actual physical orientation of a particular machine.

It will be expedient to provide a frame for supporting the shaft. This frame should be adequate to stabilize the shaft and prevent the generation of vibrations in the packaging machine, which may otherwise impair the precision of the packaging process.

According to an advantageous variant of the disclosure, a tool member on a work station is adapted to be displaced in the production direction of the packaging machine, said tool member being movable by means of the shaft. The packaging process can thus easily be adapted to varying conditions, for example, to the use of a different type of packaging materials or to the production of a different type of package shapes. In this respect, it will be particularly advantageous when the displacement or adjustment can be executed without the necessity of acting on the shaft and/or the transfer mechanism. For example, it would be imaginable that the cam mechanism acts on a horizontal cam profile and that the lifting movement of the operated tool member is independent of the actual point of application of the cam mechanism on the cam profile.

Depending on the type of work station whose tool member is to be operated, it may be advantageous to provide two transfer mechanisms for converting the movement of the shaft into the movement of a tool member of the work station. This will be particularly advantageous e.g. in the case of a cross cutter for a packaging foil. The use of two transfer mechanisms for lifting the cutting tool of the cross separator on either side of the packaging foil web prevents in this case canting of the cutting tool and guarantees thus a reliable, continuous cut through the web of packaging foil.

When two transfer mechanisms are provided, these transfer mechanisms are preferably arranged symmetrically to the central shaft, laterally displaced relative to said shaft (i.e., the transfer mechanisms are provided on different sides of the shaft, each at the same distance from said shaft) to insure that the driving forces will be transferred uniformly from the shaft to the two transfer mechanisms.

In the following description, two advantageous embodiments of the present disclosure will be explained in more detail with reference to the below drawings.

DETAILED DESCRIPTION

Figure 1:
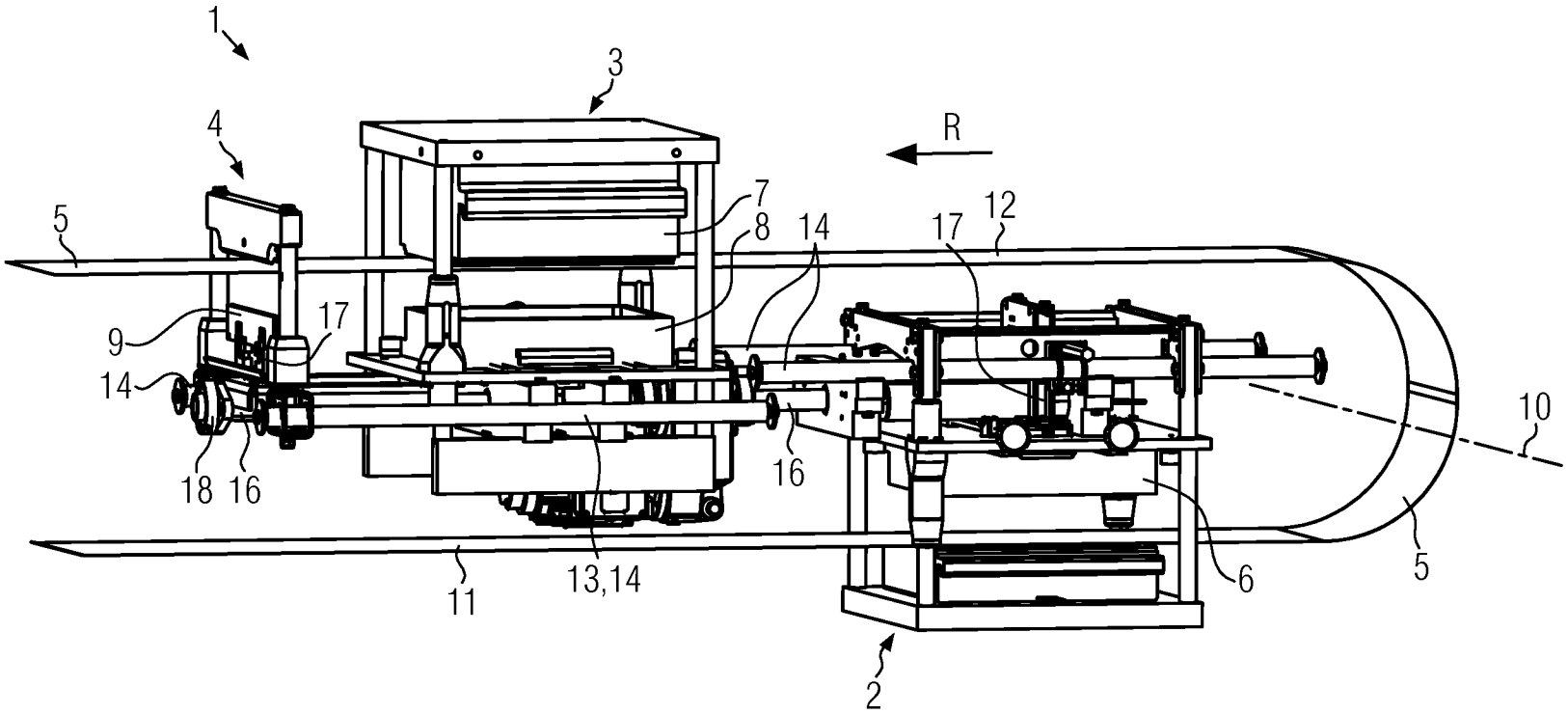
FIG. 1 is a perspective view of a detail of a first embodiment of a packaging machine according to the present disclosure, in the open condition of the tools.

Identical components are provided with identical reference numerals throughout the figures.

FIG. 1 shows a first embodiment of a packaging machine 1 according to the present disclosure in a perspective view. For the sake of clarity, only the packaging machine components which are most important to the disclosure are shown.

The packaging machine 1 is a deep-drawing packaging machine. It comprises (at least) three work stations, viz. a forming station 2, an evacuating and sealing station 3 and a separating station 4. All these work stations 2, 3, 4 act on a packaging material 5, which, in this illustrated embodiment, is a continuous web of plastic foil. The forming station 2 is provided with a forming tool 6. When the packaging material 5 is at a standstill during the intermittent operation of the packaging machine 1, the forming tool 6 is moved perpendicularly to the plane of the web-shaped packaging material 5 so as to form packaging troughs in the packaging material 5 by deep-drawing.

The sealing station 3 comprises a sealing tool top 7 and a sealing tool bottom 8. By moving the sealing tool top 7 and/or the sealing tool bottom 8 in a direction towards one another, a closed sealing chamber can be formed between the two tool members 7, 8. In said sealing chamber, the packaging trough, which has been filled with a product before conveyance to the sealing chamber, can be sealed with a top foil, which is not shown, and closed in this way. It is contemplated that it may be desirable to evacuate the sealing chamber and, consequently, the packaging trough between the two tool members 7, 8 prior to sealing and/or to flush them with a replacement gas. After the sealing step, the sealing tool top 7 and the sealing tool bottom 8 are moved apart so as to release the packaging trough, and allow further transport of the packaging material 5.

The separating station 4 is, in the present embodiment, a cross separator in which a separating knife 9 is provided as a tool member. This separating knife 9 can be moved vertically, i.e. perpendicularly to the plane of the packaging material 5, so as to cut through the web-shaped packaging material 5.

The packaging machine 1 defines a production direction R in which the packaging material 5 is conveyed through at least some of the work stations, such as, for example, in the present embodiment, through the sealing station 3 and the separating station 4. In the forming station 2, the packaging material 5 is conveyed in a direction opposite to the production direction R associated with stations 3 and 4 on the upper level before it is deflected about a virtual, horizontal axis 10 and thus transferred from a first conveying plane 11 (the lower level) to a second conveying plane 12 (the upper level).

The packaging machine 1 is provided with a frame 13, which is arranged horizontally between the two material conveying planes 11, 12. The frame 13 comprises a plurality of lateral longitudinal bars 14, which are oriented in the production direction R of the packaging machine 1, as well as a plurality of cross bars (not shown) interconnecting said longitudinal bars 14. At each work station 2, 3, 4 of the packaging machine 1, the frame 13 is provided with two longitudinal bars 14, which are oriented parallel to one another and which extend on the same level (i.e., in the same horizontal plane). These longitudinal bars 14 extend at least over the length of a work station 2, 3, 4 in the production direction R. In the packaging machine shown in FIG. 1, a first pair of longitudinal bars 14 is associated with the forming station 2. A second pair of longitudinal bars 14 extends below the sealing station 3 as well as below the separating station 4. It is contemplated that the longitudinal bars 14 may, alternatively, extend over substantially the entire length of the machine, thus defining a uniform frame 13 for all work stations 2, 3, 4.

A shaft 16, which is also oriented in the production direction R of the packaging machine 1, extends centrally between the longitudinal bars 14. The shaft 16 is connected to a drive, e.g. an electric motor, preferably a servomotor. In the present embodiment, the shaft 16 can be driven alternately in different directions of rotation.

In the area of each work station 2, 3, 4, a transfer mechanism 17 is operatively connected to the shaft 16. The transfer mechanism 17 may be an arrangement of toggle levers and/or a cam mechanism. This transfer mechanism 17 insures that the rotary movement of the shaft 16 is converted into the desired movement of the movable tool member of the respective work station 2, 3, 4, (such as, for example, the lifting movement of the forming tool 6, of the sealing tool top 7 and/or of the sealing tool bottom 8 as well as the movement of the separating knife 9). Thus, the shaft 16 acts here as a "main shaft" which controls the movements of a plurality of movable tool members 6, 7, 8, 9 of different work stations 2, 3, 4. Due to the fact that the lifting movements are controlled in common via the shaft 16, the movements of the tool members 6, 7, 8, 9 are mechanically synchronized with one another.

At the separating station 4, transfer mechanisms 17 are provided on either side of the shaft 16 so as to cause the separating knife 9 to move. The transfer mechanisms 17 are arranged symmetrically with respect to the shaft 16 (i.e., they extend at the same distance from the shaft 16 located between them).

The shaft 16 is supported in a plurality of cross bars (not shown) of the frame 13. For supporting it, friction bearings or ball bearings 18 can be provided. In particular, the shaft 16 may be arranged centrally within the packaging machine 1.

In FIG. 1 it can be seen that the forming station 2 is located below the plane of the frame 13, whereas the sealing station 3 and the separating station 4 are located above the plane of said frame 13. Due to this arrangement and due to the curved path of the packaging material 5, a very compact structural design of the packaging machine 1 is accomplished. This has the advantage that the central shaft 16 can be comparatively short, so that torsional forces within the shaft 16 will be minimized.

Figure 2:
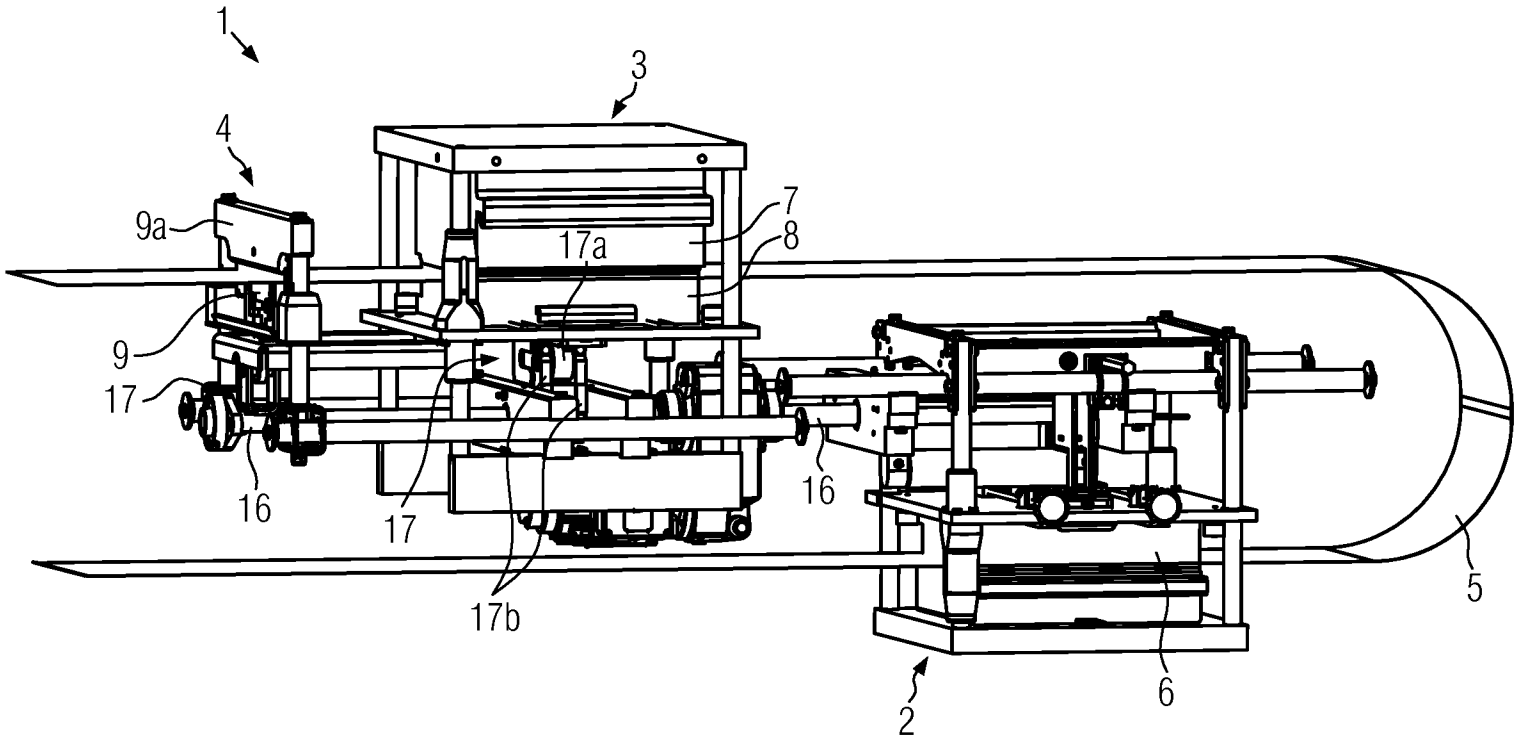
FIG. 2 is a perspective view of the packaging machine shown in FIG. 1, in the closed condition of the tools.

FIG. 1 shows the packaging machine in a condition in which the tools 6, 7, 8, 9 of the respective work stations 2, 3, 4 are open so as to allow further transport of the web-shaped packaging material 5. FIG. 2, however, shows the same packaging machine 1 in a condition in which the tool members 6, 7, 8, 9 of the work stations 2, 3, 4 are closed so as to act on the web-shaped packaging material 5. For example, the forming tool 6 of the forming station 2 is pressed downwards against the packaging material 5 so as to produce packaging troughs by deep-drawing the packaging material 5. The movement of the forming tool 6 will be explained in more detail hereinbelow on the basis of FIG. 3.

In the sealing station 3, the sealing tool bottom 8 has been lifted so as to form, together with the sealing tool top 7, a closed sealing chamber. This lifting movement of the sealing tool bottom 8 is accomplished by a rotation of the shaft 16 and by a conversion of the rotary movement of the shaft 16 into a lifting movement of the sealing tool bottom 8 by means of the transfer mechanism 17. In the embodiment shown, this transfer mechanism 17 comprises a roll 17*a*, which is adapted to be rotated about an axis oriented parallel to the production direction R and which is fixed on both sides by levers 17*b* that are fixedly attached to the shaft 16. A rotation of the shaft 16 has the effect that also the levers 17*b* will rotate about said shaft 16 and, in so doing, lift the roll 17*a*. This roll 17*a* rolls on the lower surface of the sealing tool bottom 8, said lower surface acting as a cam profile, i.e. the transfer mechanism 17 is here implemented as a cam mechanism.

A rotation of the shaft 16 additionally has the effect that the separating knife 9 of the separating station 4 is lifted in that the rotary movement of the shaft 16 is converted into a lifting movement of the separating knife 9 by means of the two laterally arranged transfer mechanisms 17. The separating knife 9 cooperates with a counterknife 9*a* so as to cut through the web-shaped packaging material 5 between the cutting edges of the two knives 9, 9*a*.

Figure 3:
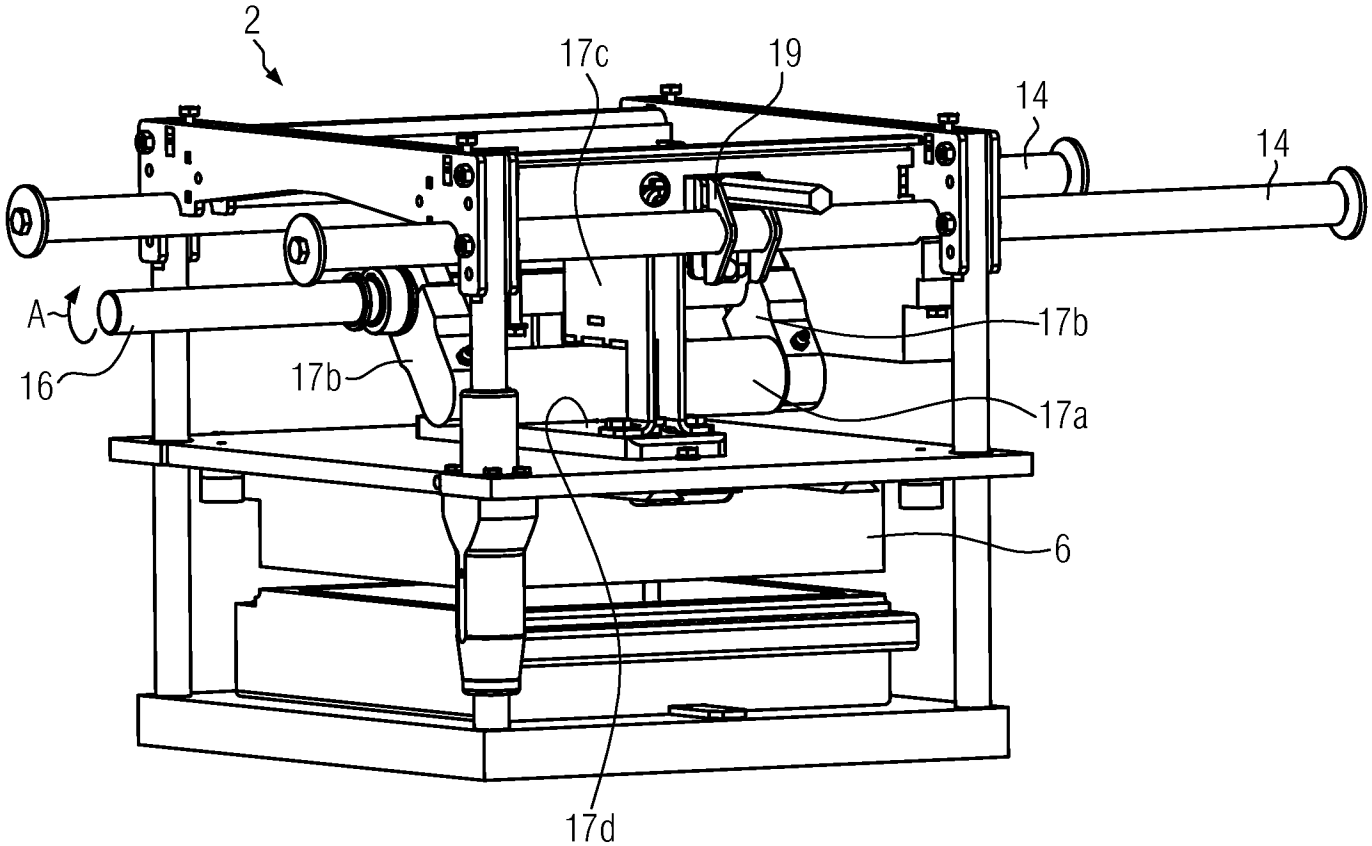
FIG. 3 is an enlarged representation of the forming station of the packaging machine shown in FIGS. 1 and 2.

FIG. 3 shows an enlarged representation of the forming station 2 of the packaging machine 1, in the case of which a few cover panels have been removed so that the interior of the forming station 2, and, in particular, the transfer mechanism 17, can be seen more easily. Just as in the case of the sealing station 3, two levers 17*b* are also here fixed to the shaft 16 so that they participate in the rotary movement of the shaft 16. A roll 17*a*, which is rotatable about an axis oriented parallel to the production direction R of the packaging machine 1, is provided between the ends of the two levers 17*b* that are remote from the shaft 16. The roll 17*a* is fully enclosed by two upright entraining plates 17*c* which are secured in position on the forming tool 6.

Starting from the half-open position of the forming station 2 shown in FIG. 3, a rotation of the shaft 16 in direction A results in a lowering of the roll 17*a*. During said lowering, the roll 17*a* presses against a cam profile 17*d* formed on the surface of the forming tool 6 so as to press the forming tool 6 downwards against the web of packaging material 5. When the packaging troughs have been deep-drawn, an opposite rotation of the shaft 16, i.e. a rotation in a direction opposite to direction A, has the effect that the roll 17*a* will be lifted. Due to the entraining plates 17*c*, the forming tool 6 will be lifted as well. An adjustment element 19 locks the transfer mechanism 17 in the longitudinal direction along the longitudinal bars 14. As soon as this adjustment element 19 has been released or unlocked, the transfer mechanism 17 can be displaced in the longitudinal direction, i.e. in the production direction R, along the longitudinal bars 14. Alternatively, it would be possible to displace the forming station 2 with the forming tool 6 in the longitudinal direction of the packaging machine 1, whereas the transfer mechanism 17 would maintain its position on the shaft 16.

Figure 4:
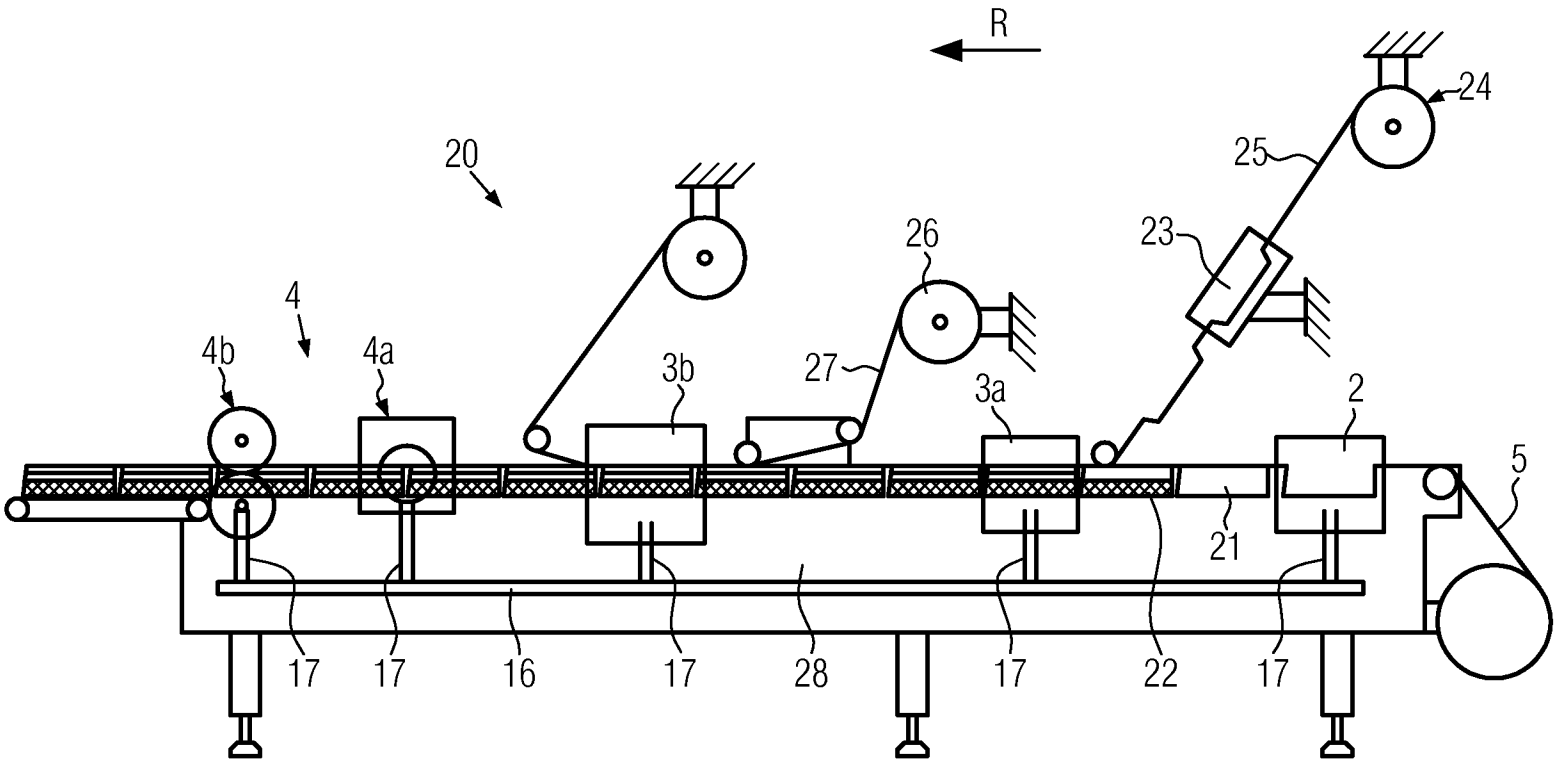
FIG. 4 is a schematic side view of a second embodiment of a packaging machine according to the present disclosure.

FIG. 4 shows in a schematic side view a second embodiment of a packaging machine 20 according to the present disclosure. Also in the case of this embodiment, the packaging machine is a deep-drawing packaging machine 20 in which packaging troughs 21 are formed in a web-shaped packaging material 5 by means of deep-drawing in a forming station 2. After having been filled with a product 22, the packaging troughs 21 are transferred to a first sealing station 3*a*. In said sealing station 3*a*, the filled packaging troughs 21 are closed with a lid, which has previously been formed by deep-drawing in a second packaging material 25 in a second forming station 23, said second packaging material 25 being also web-shaped and being unwound from a foil roll 24.

During further transport the already closed packaging troughs 21 are transferred to a second sealing station 3*b* in which a second top foil 27, which is unwound from an additional foil roll 26, is sealed onto the packaging troughs 21. Whereas the forming station 2 is, just as in the case of the first embodiment, provided with a forming tool 6 for deep drawing, the two evacuating and sealing stations 3*a*, 3*b* have, just as in the case of the first embodiment, two sealing tool members 7, 8, such as, for example, a sealing tool top 7 and a sealing tool bottom 8, which are adapted to be moved towards and away from one another.

The separating station 4 has, in the second embodiment, a cross separator 4*a* and a longitudinal separator 4*b*. In both separators 4*a*, 4*b* a separating knife 9 can be driven so as to execute a lifting movement for cutting through the foil web 5.

The work stations 2, 3*a*, 3*b*, 4*a*, 4*b* of the packaging machine 20 are arranged on a common machine frame 28. In this machine frame 28 a shaft 16 is arranged, which extends in the production direction R of the packaging machine 20. Just as in the case of the first embodiment, the shaft 16 can be supported on a frame 13. Each work station 2, 3*a*, 3*b*, 4*a*, 4*b* has provided thereon a transfer mechanism 17, preferably an arrangement of toggle levers or a cam mechanism, so as to convert the movement of the shaft 16 into a lifting movement of a tool member 6, 7, 8, 9 of the respective work station 2, 3*a*, 3*b*, 4*a*, 4*b*. Also the forming tool of the second forming station 23 can be driven by means of a suitable transfer mechanism 17 through the rotary movement of the shaft 16 such that it executes the desired lifting movement.

Starting from the embodiments shown, the packaging machine 1, 20 according to the present disclosure can be modified in many respects. In particular, it is contemplated to provide further work stations and/or to drive further tool members of the existing work stations by means of the common shaft 16.

According to another variant, it is also contemplated that at least one work station is provided with a transfer mechanism 17 in the case of which the rotary movement of the shaft 16 is converted into a linear movement, e.g. by implementing the shaft 16 as a spindle in the area of the work station and by providing a spindle nut which is attached to the shaft. The thus linearly movable spindle nut can drive a system of toggle levers for lifting and/or lowering (or for relative movement in another desired direction) a tool member.

Tool members, such as the forming tool bottom, forming tool top, sealing tool bottom or sealing tool top, can be implemented as replaceable components. The tools can preferably be removed from the packaging machine laterally (i.e., transverse) relative to the production direction. Since various media connections, such as electrical current, pressurized air, vacuum or cooling water, may be attached to the tools, these connections are configured such that they are easily releasable, preferably with a connection block which is also able to receive therein the various media and which provides the connection from the tool to the machine at the operating position. By providing suitable gasket systems and a releasable, locked condition of the tool at the operating position, the media connection may be automatically released and subsequently reestablished when a tool is changed.

A further embodiment of the deep-drawing packaging machine 1, 20 is so conceived that, in the area of the forming and/or sealing station 2, 3, a lifting device is provided, which, perpendicular to the production direction R, executes a vertical lifting movement of a part of the feed system for the web-shaped packaging material 5. The lifting movement of the feed system (such as, for example, by providing a lateral chain guide for a transport chain for transporting the packaging foil web 5) in the area of the forming station 2 has the effect that, when the forming station 2 is open, the web-shaped packaging material 5 will be spaced apart from the heating plate that heats the web-shaped packaging material 5 for the forming process, so as to prevent excessive heating of the web-shaped packaging material through radiant or contact heat. During the closing process of the forming station 2, the feed system is returned to its operating position, so that the web-shaped packaging material 5 can effectively be heated and formed. A lifting function of the forming tool top can thus be dispensed with, and the space required in this area can be reduced.

The vertical lifting device of the feed system may also be provided in other areas as needed, such as, for example, the area of the sealing station 3, if products projecting beyond the package edge, which normally also represents the sealing plane, are transported into the sealing station and if the sealing tool top 7 does not have a lifting function.

The displaceable area of the feed system is normally separate from the non-displaceable areas and is displaceable by means of pneumatic cylinders or servo drives and/or coupled to the movement of a tool bottom. A tensioning element for tensioning the transport chain could yield during the displacement of the feed system.

While embodiments of the disclosure have been illustrated and described, it is not intended that these embodiments illustrate and describe all possible forms of the disclosure. Rather, the words used in the specification are words of description rather than limitation, and it is understood that various changes may be made without departing from the spirit and scope of the disclosure.

What is claimed is:

1. A packaging machine comprising:

a plurality of work stations, each of the work stations are operable in synchronism with one another and the work stations are sequentially arranged to define a production direction of the packaging machine, each of the work stations including at least one movable tool member, each work station acting upon a packaging material that is conveyed through the plurality of workstations, a rotationally driven shaft arranged to extend generally parallel to the production direction of said packaging machine, and at least one transfer mechanism associated with each of the movable tool members, each of the at least one transfer mechanisms being operatively connected to the driven shaft for converting the movement of the driven shaft into the movement of the respective tool member, wherein the at least one tool member of a first work station acts upon the packaging material on a first conveying plane and the at least one tool member of a second workstation acts upon the packaging material on a second conveying plane and at least one of the first and second work stations is adapted to be displaced in the production direction of the packaging machine to vary a distance that the packaging material is conveyed between the first and second workstations.

2. A packaging machine according to claim 1 wherein the transfer mechanism comprises an arrangement of at least one toggle lever and a cam mechanism.

3. A packaging machine according to claim 2 wherein the cam mechanism includes a wheel rolling along a cam surface.

4. A packaging machine according to claim 1 wherein the shaft is driven alternately in both directions of rotation.

5. A packaging machine according to claim 1 wherein the work stations include a forming station, a sealing station, and a separating station, and wherein the rotation of the driven shaft is converted by at least one of the transfer mechanisms associated with each of said forming station, sealing station, or separating station, to provide a lifting movement of at least one tool member associated with the forming station, the sealing station or separating station.

6. A packaging machine according to claim 1 further including a frame for supporting the shaft.

7. A packaging machine according to claim 1 wherein at least one of the plurality of work stations includes two transfer mechanisms operably connected to the driven shaft and to a tool member for converting the movement of the shaft into the movement of the tool member.

8. A packaging machine according to claim 7 wherein the two transfer mechanisms are mounted symmetrically relative to, and are laterally displaced from, the shaft.

* * * * *